US007118809B2

(12) United States Patent
Utsumi et al.

(10) Patent No.: US 7,118,809 B2
(45) Date of Patent: Oct. 10, 2006

(54) HIGH-STRENGTH HOT-DIP GALVANIZED STEEL SHEET WITH EXCELLENT SPOT WELDABILITY AND STABILITY OF MATERIAL PROPERTIES

(75) Inventors: Yukihiro Utsumi, Kakogawa (JP); Katsuhiro Yamamoto, Kakogawa (JP)

(73) Assignee: Kobe Steel, Ltd., Kobe (JP)

( * ) Notice: Subject to any disclaimer, the term of this patent is extended or adjusted under 35 U.S.C. 154(b) by 0 days.

(21) Appl. No.: 11/110,930

(22) Filed: Apr. 21, 2005

(65) Prior Publication Data

US 2005/0247383 A1 Nov. 10, 2005

(30) Foreign Application Priority Data

May 6, 2004 (JP) ..... 2004-137735

(51) Int. Cl.
*B32B 15/01* (2006.01)
*B32B 15/04* (2006.01)
*B32B 15/18* (2006.01)
*B05D 1/18* (2006.01)

(52) U.S. Cl. ..... 428/659; 428/684; 428/220; 427/433

(58) Field of Classification Search ..... 428/658, 428/659, 681, 684, 687, 220, 332; 427/431, 427/433

See application file for complete search history.

(56) References Cited

U.S. PATENT DOCUMENTS 6,312,536 B1 11/2001 Omiya et al. ..... 148/533
2003/0106620 A1 6/2003 Nagataki et al. ..... 148/602
2003/0129444 A1 7/2003 Matsuoka et al. ..... 428/659
2003/0221752 A1 12/2003 Utsumi et al. ..... 148/334
2004/0238080 A1* 12/2004 Vandeputte et al. ..... 148/602

FOREIGN PATENT DOCUMENTS

JP 1-198459 8/1989
JP 5-105960 4/1993
JP 11-193419 7/1999

OTHER PUBLICATIONS

Yoshinobu Omiya, et al., "Characteristics of 590MPa Grade Low YP Type Hot Dip Galvannealed Steel Sheet", Dec. 2002, R & D Kobe Steel Engineering Reports, vol. 52, No. 3, pp. 10-14.

* cited by examiner

*Primary Examiner*—Michael E. Lavilla
(74) *Attorney, Agent, or Firm*—Oblon, Spivak, McClelland, Maier & Neustadt, P.C.

(57) ABSTRACT

A high-strength hot-dip galvanized steel sheet is provided which comprises a composite structure consisting essentially of ferrite and martensite. The steel comprises, by mass %, C: 0.05 to 0.12%, Si: not more than 0.05%, Mn: 2.7 to 3.5%, Cr: 0.2 to 0.5%, Mo: 0.2 to 0.5%, Al: not more than 0.10%, P: not more than 0.03%, and S: not more than 0.03%. The high-strength hot-dip galvanized steel sheet has not only excellent spot weldability, but also excellent "stability of material properties", including tensile strength, total elongation, and yield strength, in a high range of strengths from 780 to 1180 MPa, even if the manufacturing condition (especially, the condition of the cooling process after annealing the steel sheet) is changed.

9 Claims, 4 Drawing Sheets

HIGH-STRENGTH HOT-DIP GALVANIZED STEEL SHEET WITH EXCELLENT SPOT WELDABILITY AND STABILITY OF MATERIAL PROPERTIES

BACKGROUND OF THE INVENTION

1. Field of the Invention

The present invention relates to a hot-dip galvanized steel sheet with excellent spot weldability and stability of material properties. More particularly, the invention relates to a high-strength hot-dip galvanized steel sheet with excellent spot weldability and stability of material properties, including tensile strength (TS), elongation (total elongation, EL), and yield strength (YP), regardless of conditions of a cooling process after annealing (soaking) the steel sheet, variations in these properties being very few, in a high range of the tensile strengths (TS) from 780 to 1180 MPa.

2. Description of the Related Art

Recently, there have been increasing demands for improvement in collision safety performance of vehicles or the like. High-strength steel sheets are widely employed in frames of a vehicle body and the like so as to ensure the passenger's safety on collision, and to improve fuel economy by reducing an increase in the vehicle weight, which brings about by attachment of a fail-safe device. In particular, in order to prevent a part of the bent frame from entering a cabin of the vehicle when it is hit from the side, high-tensile-strength steel sheets with an extremely high tensile strength of about 780 to about 1180 MPa are used. Among them, a composite structural (or dual phase, which is abbreviated to "DP") steel sheet, which consists essentially of ferrite and martensite, are often used for multipurpose applications because of both excellent strength and ductility. Since steel sheets for the vehicle require excellent capability of corrosion prevention, a hot-dip galvanized steel sheet having a composite structure, and a galvannelaed steel sheet which is obtained by applying an alloying procedure to the hot-dip galvanized steel sheet, have been developed as the steel sheets with both these properties (for example, see JP-A No. 198459/1989, JP-A NO. 105960/1993 and JP-A No. 193419/1999).

Any one of the documents above discloses that a high-strength hot-dip galvanized steel sheet with excellent formability and the like is produced by optimizing manufacturing conditions of a continuous hot-dip galvanizing line using steel whose chemical composition is controlled.

"Properties of 590 MPa grade low YP type hot-dip galvannealed steel sheet", December 2002, R & D KOBE STEEL ENGINEERING REPORTS, vol. 52 No. 3, by Yoshinobu Oomiya et al. discloses a hot-dip galvanized steel sheet with a tensile strength level of 590 MPa, and not of 780 to 1180 MPa, which has enhanced formability and spot weldability by transforming a three-phase structure including ferrite, martensite, and bainite into a complete composite structure composed of ferrite and martensite by compositional addition of small amounts of Cr and Mo.

It is well known that composite structural or dual phase steel sheets consisting essentially of ferrite and martensite vary greatly in material properties (which mean mechanical properties of steel sheets, more particularly, tensile strength, total elongation, and yield strength in the invention), depending on the conditions of the cooling process (cooling rate, and cooling hold temperature) after annealing (soaking) the steel sheet. Generally, hot-dip galvanized steel sheets (and further hot-dip galvannealed steel sheets) are produced by pickling a hot-rolled steel sheet, cold rolling the pickled sheet to form a cold-rolled steel sheet, and then performing hot-dip galvanizing (and further alloying) of the cold-rolled steel sheet in a continuous hot-dip galvanizing line. In the continuous hot-dip galvanizing line, an annealing (soaking) process is performed in a continuous annealing furnace, a cooling process is performed until the annealed steel is cooled to a temperature for the hot-dip galvanizing after the annealing, and then a galvanizing process is performed. In the cooling step among them, austenite is normally transformed into a rigid structure including martensite, bainite, and the like, by forced cooling means, such as gas cooling, mist cooling, or roll cooling which involves bringing the steel sheet into a contact with a cooled roll skid. Thus, though the cooling rate and cooling termination temperature must be strictly controlled to obtain a desired composite structural steel sheet, it is very difficult to constantly perform and control the cooling on certain conditions on an actual manufacturing floor for various reasons. The thus-obtained products vary greatly in material properties, disadvantageously resulting in a problem that cracks and the like occur due to variations in dimensional accuracy in press forming.

Accordingly, a hot-dip galvanized steel sheet which exhibits high strength ranging from about 780 to 1180 MPa is required to be provided which has not only excellent inherent spot weldability, but also excellent stability of material properties regardless of manufacturing conditions (in particular, the cooling process of the steel sheet after annealing), variations in the material properties being very few. None of JP-A No. 198459/1989, JP-A NO. 105960/1993 and JP-A No. 193419/1999, however, discloses the steel sheets manufactured for such a purpose. Thus, the steel sheets disclosed therein have insufficient stability of material properties. It should be noted that since "Properties of 590 MPa grade low YP type hot-dip galvannealed steel sheet" above fails to take into consideration a range of strengths from about 780 to 1180 MPa, as distinct from the invention, this document basically differs from the invention in the idea of chemical composition design for the purpose of obtaining the desired properties (as described later).

SUMMARY OF THE INVENTION

The present invention has been accomplished in view of the foregoing problems, and it is an object of the invention to provide a high-strength hot-dip galvanized steel sheet having not only excellent spot weldability, but also excellent "stability of material properties", including tensile strength, total elongation, and yield strength, in a high range of strengths from 780 to 1180 MPa, even if the manufacturing condition (especially, the condition of the cooling process after annealing the steel) is changed, variations in these properties being very few.

A hot-dip galvanized steel sheet according to the present invention which has solved the above-mentioned problems has excellent spot weldability and stability of material properties is characterized in that a steel of the hot-dip galvanized steel sheet comprises a composite structure having 95 area % or more of the ratio of a total area of ferrite and martensite to that of the entire structure, and that the steel of the hot-dip galvanized steel sheet comprises, by mass % (the contents of the following elements being expressed in the same manner), C: 0.05 to 0.12%, Si: not more than 0.05%, Mn: 2.7 to 3.5%, Cr: 0.2 to 0.5%, Mo: 0.2 to 0.5%, Al: not more than 0.10%, P: not more than 0.03%, and S: not more than 0.03%, and that the hot-dip galvanized steel sheet has a tensile strength in a range from 780 to 1180

Mpa and a ductility ratio of 0.40 or more, the ductility ratio being ratio of cross tensile strength to shear tensile strength.

According to the present invention, there has been provided a high-strength hot-dip galvanized steel sheet having not only excellent spot weldability, but also excellent "stability of material properties", including tensile strength, total elongation, and yield strength, in a high range of strengths from about 780 to 1180 MPa, regardless of manufacturing conditions (particularly, a condition of a cooling process after annealing the steel), variations in these properties being very few.

DESCRIPTION OF THE PREFERRED EMBODIMENTS

Figure 1:
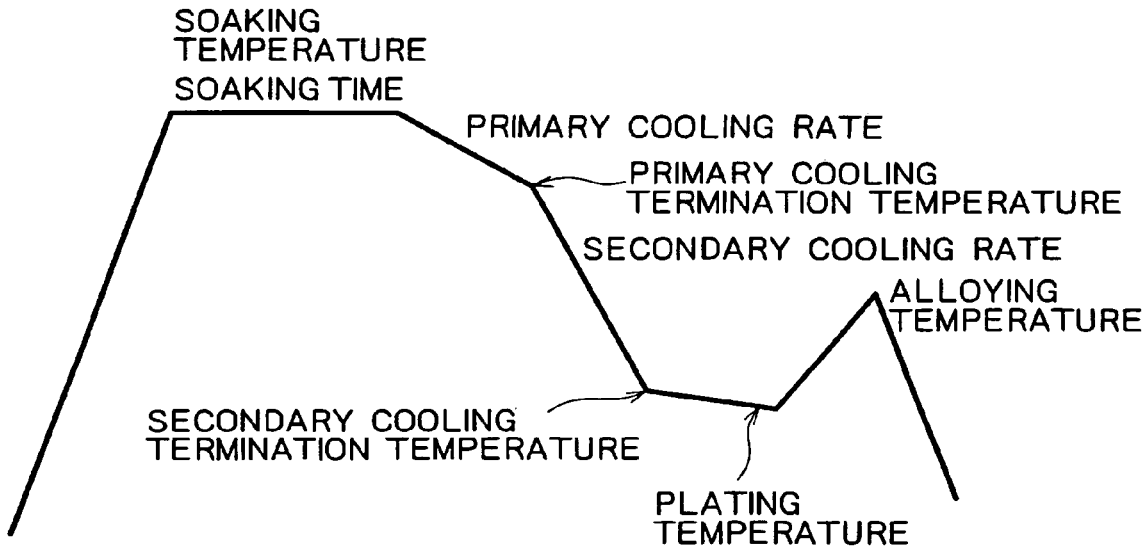
FIG. 1 is a diagram showing a heat cycle pattern in a hot-dip galvanizing line for manufacturing a steel sheet according to the present invention.

The inventors have been dedicated themselves to studying components of steel in order to provide a hot-dip galvanized steel sheet with both excellent spot weldability and stability of material properties in a high range of about 780 to 1180 MPa. As a result, the inventors have found that it is important to add elements Cr and Mo as essential ones to basic elements C, Si, and Mn, and to control the content of each of these elements within a predetermined range so as to obtain the steel sheet with the desired properties, whereby the inventors have accomplished the invention. Basic concepts of these respective elements are as follows:

The C content is decreased as much as possible (not more than 0.12%), thereby improving the spot weldability.

The Si content is decreased as much as possible (not more than 0.05%), thereby preventing harmful effects, including no galvanized finish in a galvanize process (that is, a phenomenon in which the galvanize does not adhere to the steel sheet due to decreased adhesion of the galvanize) and the like.

Both the elements Cr and Mo are added in small amounts (each in an amount of 0.2 to 0.5%), and the Mn content added is as large as possible (2.7 to 3.5%). This achieves in particular the stability of material properties because any one of these elements is useful to stabilize an austenite phase, and to facilitate the formation of a rigid phase in the cooling process, thereby obtaining low yield rate and high strength.

It should be noted that individual effects of the above-mentioned elements are well known in the art, and the composition design using these effects is also formulated in JP-A No. 198459/1989, JP-A NO. 105960/1993 and JP-A No. 193419/1999. However, it has become evident from the results of the inventor's studies that since the above documents do not take an approach to the composition design particularly from a viewpoint of the stability of material properties unlike the invention as mentioned above, the compositions disclosed in examples of the above documents cannot provide the desired properties. That is, in JP-A No. 198459/1989, the Mn amount is small, and only one of the Cr and Mo is added. In JP-A NO. 105960/1993, only the Mo is added, but the Cr is not added at all. In JP-A No. 193419/1999, the C amount is large, the Mn amount is small, and only one of the Cr and Mo is added, in order to improve the formability or the like in a range of strength grades substantially from about 490 to 780 MPa. The inventors have confirmed by way of the following examples that the steel sheets with such chemical compositions are inferior particularly in terms of the stability of material properties. The inventors have also confirmed the following by way of the after-mentioned examples. "Properties of 590 MPa grade low YP type hot-dip galvannealed steel sheet" above differs from the invention in the basic concept of the composition design because of different strength ranges of interest, and discloses the Mn amount of the steel decreased taking the spot weldability into consideration, thus failing to obtain the desired material properties.

As can be seen from the above descriptions, in the invention, the elements C, Si, Mn, Cr, and Mo are treated as essential elements, and the added amounts thereof are minutely controlled to provide the hot-dip galvanized steel sheet with both excellent spot weldability and stability of material properties in a high range of strengths from about 780 to 1180 MPa. Further, the inventors have found that if the added amount of any one of these elements deviates from the range limited by the invention, the intended object cannot be achieved. This is how the invention has been accomplished.

Now, the steel components which characterize the invention most will be explained below. The contents of the following chemical compositions are expressed in units of by mass %.

C:0.05 to 0.12%

The element C is an element essential to strengthen the steel sheet, and is added in an amount of not less than 0.05% so as to obtain the desired strength, and preferably not less than 0.08%. Note that since the steel with the C content exceeding 0.12% leads to degradation in the spot weldability, the C content should be up to a maximum of 0.12%, and preferably 0.10% or less.

Si: not more than 0.05% (not including 0%)

The excessive addition of the element Si leads to failure in the appropriate formation of a plated layer, resulting in the harmful effects including bore spot. Thus, the Si content is preferably as small as possible, and should be up to a maximum of 0.05% in the invention, and preferably 0.03% or less.

Mn: 2.7 to 3.5%, Cr: 0.2 to 0.5%, and Mo: 0.2 to 0.5%

As mentioned above, each of these elements is useful to improve the stability of material properties, and is a very important element to the invention. When the content of each added element is less than the minimum, large variations occur in the material properties. In contrast, when the content of each added element exceeds the maximum, formability is lowered.

It is known that excessive addition of the element Mn among these elements inhibits the spot weldability, as is the case with the element C. Thus, in "Properties of 590 MPa grade low YP type hot-dip galvannealed steel sheet" above, the Mn content is decreased. In the invention, however, the C content is decreased instead of the Mn to improve the spot weldability. The inventors has confirmed by way of the following examples that the hot-dip galvanized steel sheet with both excellent spot weldability and stability of the material properties is not obtained until the C content is decreased. The Mn content is preferably not less than 2.9%, and not more than 3.2%.

Further, in the invention, both the elements Cr and Mo are added as the essential elements. Since these elements are judged to have the same effects, including an effect of enhancing hardenability, most of the conventional hot-dip galvanized steel sheets have one of the elements Cr and Mo added thereto (for example, see JP-A No. 198459/1989, JP-A NO. 105960/1993 and JP-A No. 193419/1999). But both these elements should be added in small amounts within the respective ranges specified above from a viewpoint of the stability of material properties. The inventors have confirmed by way of the following examples that the addition of only one of these elements, or the composite addition of the elements Cr and Mo, the added amount of each of which deviates from the described range, leads to variations in the material properties.

Al: not more than 0.10%

The element Al is useful for deoxidization, and thus should be added in an amount of not less than 0.01%. Note that the excessive addition of Al saturates the effect of the deoxidization, and is economically useless, as well as induces the galvanizing failure. Accordingly, the Al content is restricted to up to a maximum of 0.10%, and preferably not more than 0.06%.

P: not more than 0.03%

The element P is a useful element to ensure the strength of the material. However, the excessive addition of P lowers not only the formability, but also the spot weldability. Accordingly, the P content is up to a maximum of 0.03%, and preferably not more than 0.01%.

S: not more than 0.03%

The element S forms sulfide-based inclusions, such as MnS, which might cause occurrence of cracks. Particularly, since the Mn content is large in the invention as described above, the S content is preferably as small as possible. The S content is up to a maximum of 0.03%, and preferably not more than 0.01%.

The steel sheet of the invention comprises the above-mentioned elements, and the balance substantially of iron and unavoidable impurities. The steel sheet can contain the unavoidable impurities, such as N (nitrogen), or O (oxygen), the content of which is not more than 0.01%, as elements intruded from circumstances, including a raw material, a resource, manufacturing equipment, or the like. Note that the excessive presence of N precipitates a large amount of nitride, which might cause degradation in ductility. Accordingly, the N content is preferably restrained to not more than 0.0060%, more preferably not more than 0.0050%, and further preferably not more than 0.0040%. Although the N content is preferably small in the steel sheet, the minimum N content is approximately 0.0010% taking into consideration the possibility of reduction in the N content in operation.

Further, in the invention, the following element can be added to the steel within a range that does not adversely affect the aforesaid effects of the invention. That is, the invention can be applied to a steel sheet which contains, e.g. the element Ti or Nb as a selection element in a range of 0.1% or less for the purpose of precipitation strengthening, or solid solution strengthening, or which contains, e.g. the element B in an amount of not more than 0.005%.

The steel sheet of the invention with such a chemical composition is composed of the composite structure (DP), which consists essentially of ferrite and martensite. The term "essentially" means that, when the steel sheet is observed with an optical microscope (at 1000-fold magnification), the ratio of a total area of ferrite and martensite to that of the entire structure (in the case of the structure, all "%" corresponding to "area %") is 95% or more (and preferably 98% or more). Therefore, in the invention, as long as the total area of the ferrite and martensite is within the above-mentioned range, intrusion of other structural components (e.g. bainite, pearlite, or the like), which are unavoidably left behind in the manufacturing steps, may not be eliminated.

Now, a typical method for manufacturing the hot-dip galvanized steel sheet according to the invention will be described hereinafter.

The steel sheet of the invention is produced by pickling a hot-rolled steel sheet, cold rolling the pickled sheet to form a cold-rolled steel sheet, and then performing hot-dip galvanizing of the cold-rolled steel sheet in a continuous hot-dip galvanizing line, as is the case with the normal hot-dip galvanized steel sheet.

Among the manufacturing conditions, a condition for the hot rolling to produce the hot-rolled steel sheet, a condition for the pickling, a condition for the cold rolling to produce the cold-rolled steel sheet, and a condition for galvanizing to be carried out in the hot-dip galvanizing process are not particularly limited, and hence the conditions which are normally employed in manufacturing the hot-dip galvanized steel sheet can be employed in the invention. More specifically, in the hot rolling, a heating temperature is set to a range from 1100 to 1250° C., a finishing temperature to not less than 840° C., and a coiling temperature to not less than 500° C. A cold rolling ratio and the like in the cold rolling are not particularly limited.

It should be noted that the steps in which the thus-obtained cold-rolled steel sheet is subjected to an annealing (soaking) process and is cooled until it is galvanized after the annealing in the continuous hot-dip galvanizing line are recommended to be carried out as follows. These steps will be hereinafter described in detail with reference to FIG. 1, which illustrates a heat cycle pattern in the hot-dip galvanizing line.

First, in the soaking process, the temperature is set to a range from 820 to 900° C., and the time or period to a range from 15 to 180 seconds. This soaking process is very critical to form a hard phase (martensite, which may contain bainite in some cases), which is useful to ensure the high strength. Note that when the soaking temperature is less than 820° C., the strength is enhanced and the formability is degraded (see FIG. 2, which will be described later). In contrast, when the soaking temperature exceeds 900° C., the size of crystal grains is increased, and the formability is degraded. When the soaking temperature is less than 15 seconds, a homogeneous structure is not obtained, and the material properties are degraded. In contrast, when the soaking time exceeds 180 seconds, the inherent effects are saturated, the productivity is impaired, and the costs of fuel and the like are increased. Accordingly, the soaking time is preferably not less than 30 seconds, but not more than 120 seconds.

Then, the sheet is cooled until it reaches the temperature of the hot-dip galvanizing process. A cooling pattern is set to avoid a pearlite transformation area in order to prevent the austenite from being transformed into the pearlite during cooling (which is not desirable in the invention). More specifically, the sheet may be cooled at uniform rate until it reaches the galvanizing temperature. Alternatively, a multi-stage cooling method may be employed which involves changing the cooling rate a plurality of times during cooling. In the case of the composite structural or dual phase steel sheet like the invention, which consists essentially of the ferrite and the martensite, the use of the multi-stage cooling method is recommended from a viewpoint of introducing the stabilized ferrite.

The above-mentioned multi-stage cooling method comprises cooling the steel at an average cooling rate of not more than 20° C./sec. to a temperature of 500 to 650° C. (primary cooling), and then cooling the steel at an average cooling rate of not more than 40° C./sec. to a temperature of 450 to 550° C. (secondary cooling). In the invention, the minimum of the average cooling rate in each step is not particularly defined. That is, it is confirmed by experiments that, for example, even if the steel is cooled at an average cooling rate of about 1° C./sec, the steel sheet without variations in the material properties is obtained (see FIGS. 3 and 4 as will be described later), which is one of the features of the invention.

This feature of the invention will be hereinafter described in a little more detail. Generally, for the purpose of avoiding the pearlite transformation area, the hot-dip galvanized steel sheet previously needs a cooling process prior to the hot-dip galvanizing process after annealing, in which the steel is rapid cooled at an average cooling rate of about 10° C./sec. or more. Thus, the cooling process employs a cooling means, such as gas cooling, mist cooling, or roll cooling which involves bringing the steel sheet into a contact with a cooled roll skid. For example, in an example of the above multi-stage cooling method, the method which comprises cooling the steel sheet by changing the average cooling rate in a slow cooling zone is employed, and thus intends to strictly control the cooling rate and the cooling termination temperature in each step. In fact, however, even if the above cooling means is used, it is very difficult to control the average cooling rate to a set value. The actual cooling rate and cooling termination temperature vary greatly, resulting in a problem that variations become large in the material properties. Accordingly, in the invention, the compositions of the steel are set to ensure stabilized material properties regardless of variations in the cooling pattern as mentioned above. This successfully provides, for the first time, the hot-dip galvanized steel sheet which has the excellent stability of material properties even if the average cooling rate varies after the annealing process till the galvanizing process.

Therefore, although, in the invention, the minimum average cooling rate after the annealing until the galvanizing is not particularly limited, the maximum average cooling rates in the above primary and secondary cooling steps are preferably 20° C./sec. and 40° C./sec., respectively, from a viewpoint of the stability of material properties.

After the hot-dip galvanized steel sheet is manufactured as mentioned above, it may be subjected to an alloying process to produce a hot-dip galvannealed steel sheet. This kind of the hot-dip galvannealed steel sheet is included within the scope of the invention. The aforesaid alloying process is not particularly specified, and hence may be carried out at a temperature normally employed (about 400 to 700° C.) to galvanize the steel. After the alloying process, another cooling process is conducted. An average cooling rate at this time is not also particularly limited, but recommended to be, for example, 5° C./sec. or more.

EXAMPLE

Now, the invention will be hereinafter described more specifically by way of examples. It is understood that the invention is not to be limited to the following specific examples, and that various appropriate modifications can be added and devised to be applied within the scope of the invention mentioned above and below, and are intended to be included in the technical scope of the invention.

Example 1

Steels of the types A to O with chemical compositions given in Table 1 each were melted in a steel converter to form slabs having a thickness of 230 mm. Each of these samples was subjected to hot rolling on the following conditions: a heating temperature of 1200° C.; a finishing temperature of 850 to 900° C.; a coiling temperature of 510 to 600° C. As a result, hot-rolled steel sheets having a thickness of 2.8 mm were obtained. Then, each hot-rolled steel sheet was pickled to remove surface scale, and subjected to cold rolling, thereby to obtain a cold-rolled steel sheet of 2.0 mm in thickness. The thus-obtained cold-rolled steel sheet was subjected to annealing on the annealing (soaking) condition, and to a hot-dip galvanizing process on the hot-dip galvanizing conditions (cooling and galvanizing), as shown in Table 2, so that a hot-dip galvanized steel sheet with one side plated was obtained (one side: 45 g/m$^2$).

The strength (TS), yield strength (YP), and elongation (EL) of the thus-obtained steel sheets were measured using JIS.No.5 test pieces prepared therefrom.

In addition, the spot weldability of them was evaluated in the following manner.

First, each of the above hot-dip galvanized steel sheets was welded on the following spot welding conditions. Then, a shear-tensile specimen and a cross-tensile specimen, which were defined by a current condition that a diameter of the welded metal part (Nugget diameter) was 7 mm, were respectively prepared from the welded steel sheets.

Current: Dome Radius type electrode with a top diameter of 8 mm

Welding time: 26 cycles

Hold time: 1 cycle

Welding pressure: 6450 N

The shear tensile strength (TSS) and cross tensile strength (CTS) of each of the thus-obtained specimens were measured to calculate a ductility ratio (CTS/TSS). The steel sheet with the ductility ratio of 0.40 or more was evaluated as "a steel sheet with excellent spot weldablity" (example of the invention).

It should be noted that not only the shear-tensile specimen, but also the cross-tensile specimens were prepared to evaluate the spot weldability in the invention because it is considered that the cross tensile strength tends to be markedly decreased in the high strength range (particularly, 980 MPa grade). The evaluation method of the spot weldability based on the above-mentioned "ductility ratio" is especially useful as an evaluation method that takes this into consideration.

The results of these evaluations were shown in Table 3. Note that all these steel sheets were confirmed to be a composite structure consisting essentially of ferrite and martensite of 95% or more in total.

[Table 1]

[Table 2]

[Table 3]

The following can be considered based on Table 3. Among the steels of the types A to O as shown in Table 1, all the steels of the types A, B, D, G, H, J, K, and M are the examples that meet the chemical composition requirement according to the invention. These steel sheets exhibit excellent spot weldability with the ductility ratio of 0.40 or more even if the annealing condition, the cooling pattern carried out after the annealing, and the galvanizing temperature are variously changed as shown in Table 2. Also, these steel sheets are found to have excellent stability of material properties because a variation in YP of each steel sheet (difference in YP between the conditions for each process)

is restricted to 18 MPa or less, a variation in TS (difference in TS between the conditions for each process) to 13 MPa or less, and a variation in EL (difference in EL between the conditions for each process) to 1.8% or less, respectively.

In contrast, the after-mentioned examples that do not meet any of requirements specified by the invention have the following problems.

When using each of the Type C and F steels with the large amount of the C and the small amount of the Mn, variations in the process conditions drastically changed the values of YP and TS. The ductility ratio was less than 0.40, and the spot weldability was degraded.

When using the type E steel with the small amount of the Mn, variations in the process conditions drastically changed the values of YP and TS. When using the O type steel with the large amount of Mn, the ductility was degraded.

When using the type I steel with the large amount of the C, the ductility ratio was less than 0.40, and the spot weldability was degraded.

When using the type L steel with an element Mo not being added thereto, and the type N steel with the small amount of the Cr, variations in the process conditions changed both of the values of YP and TS.

Figure 3A:
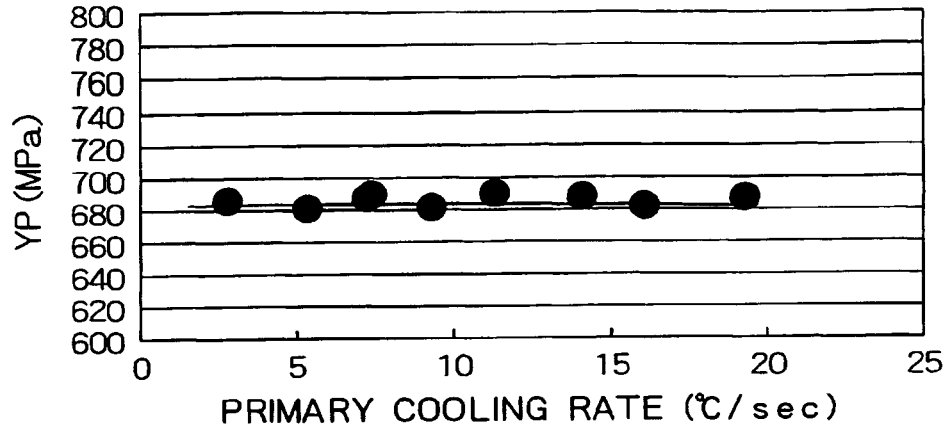
FIG. 3 is a graph showing a relationship between primary cooling rates after soaking and various material properties (YP, TS, and EL) when using the type A steel.
Figure 3B:
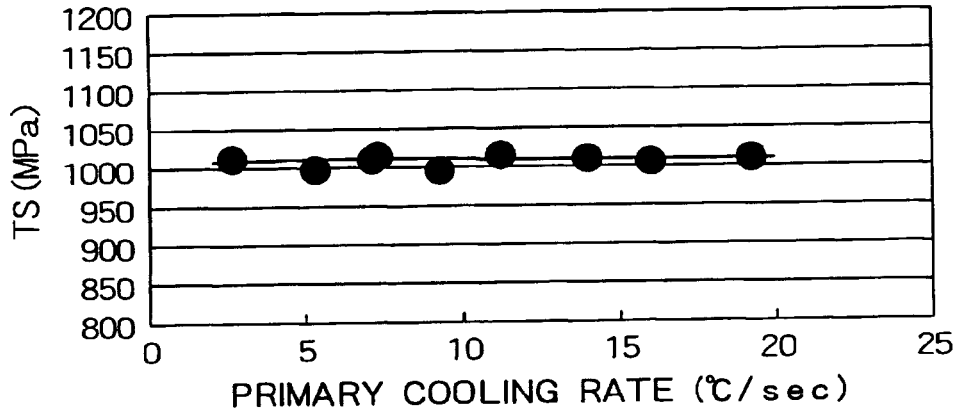
Figure 3C:
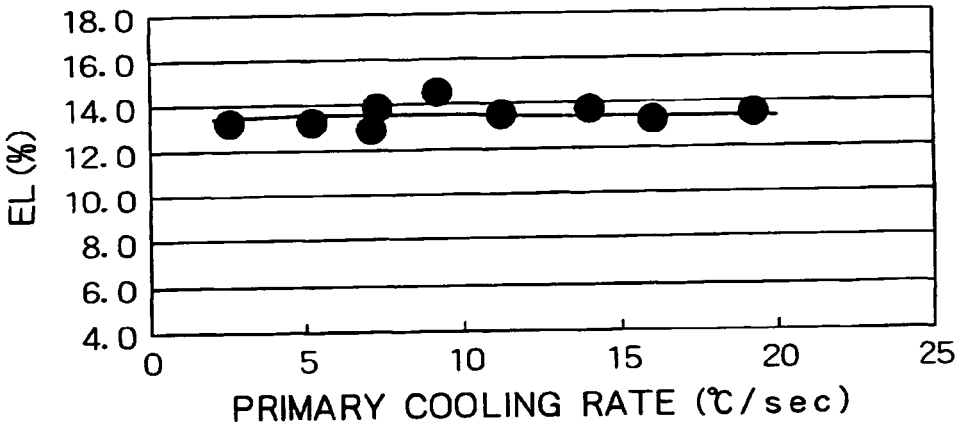
Figure 4A:
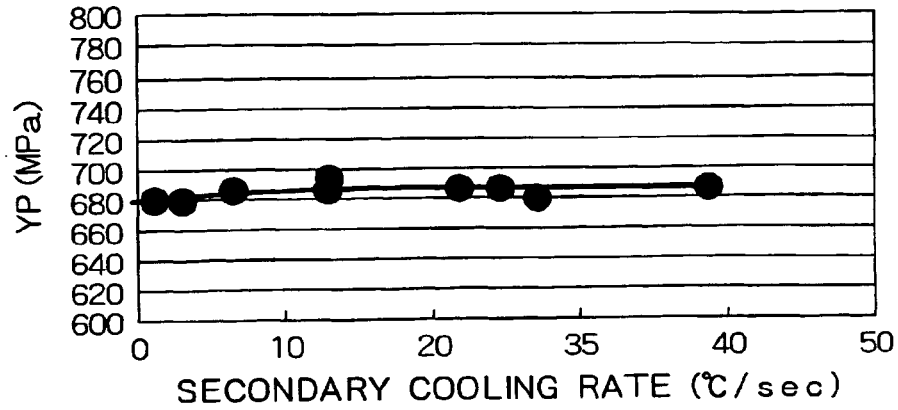
FIG. 4 is a graph showing a relationship between secondary cooling rates after soaking and various material properties (YP, TS, and EL) when using the type A steel.
Figure 4B:
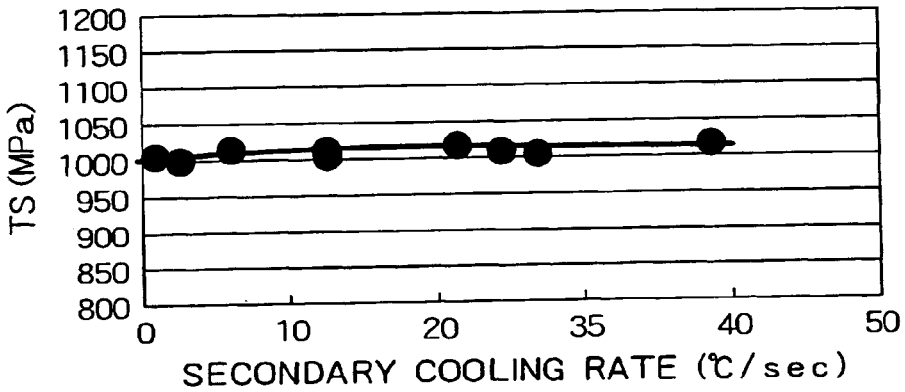
Figure 4C:
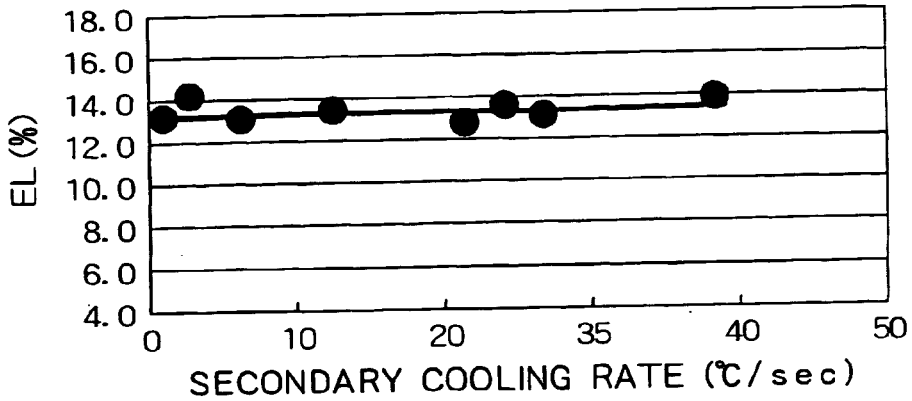

Next, the type A steel given in Table 1 (the example of the invention) was used to be subjected to the hot rolling, pickling, and cold rolling in the described manner. Thereafter, the steel was annealed for 50 seconds by changing the soaking temperature (annealing temperature) in a range between about 780 to 880° C. (see FIG. 2), and was cooled by changing the cooling pattern after the annealing (primary cooling rate and secondary cooling rate) in such a manner as shown in FIGS. 3 and 4. Various properties (TS, YP, and EL) of the steel sheets were measured at each time point after each of the above-mentioned annealing and cooling processes in the same method as mentioned above. The results of these evaluations were shown in FIGS. 2 to 4.

Figure 2A:
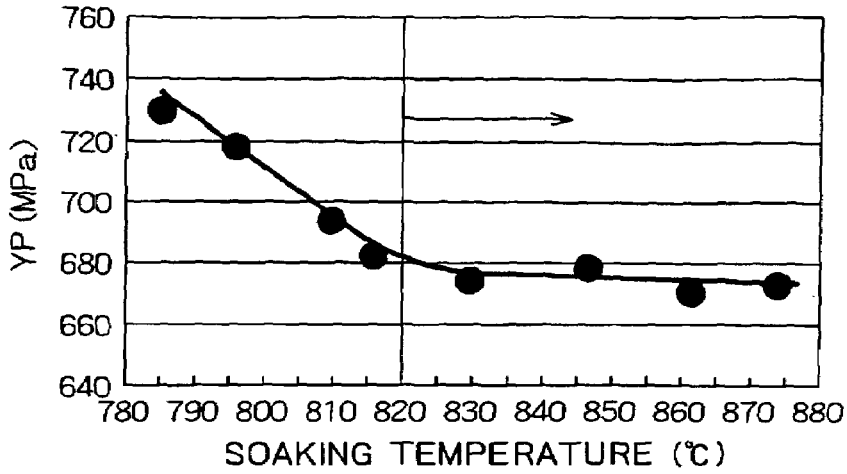
FIG. 2 is a graph showing a relationship between soaking temperatures and various material properties (YP, TS, and EL) when using the type A steel.
Figure 2B:
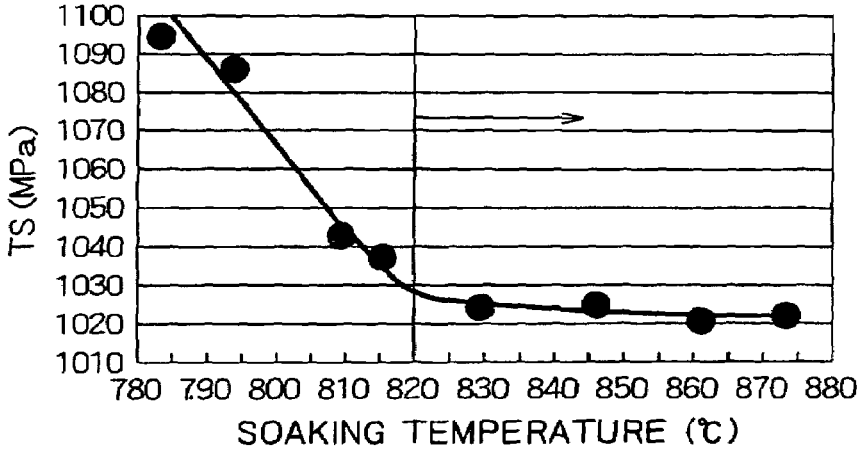
Figure 2C:
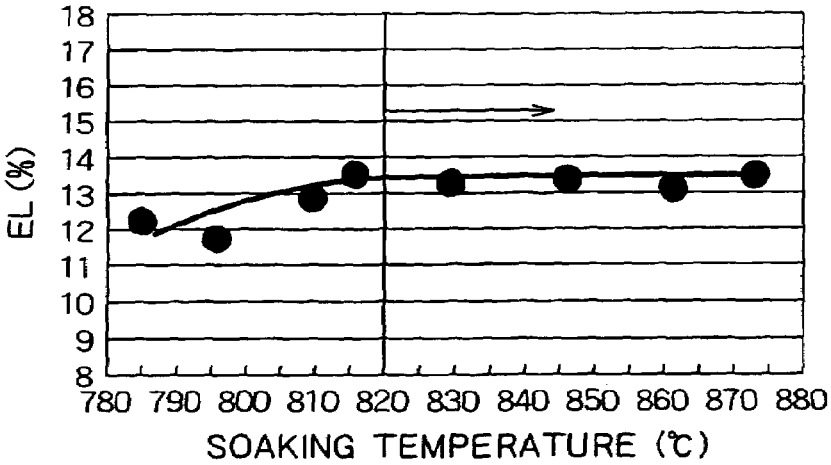

FIG. 2 is a graph showing the results of measuring the tensile strength (TS), the yield strength (YP), and the elongation (EL) of the steel sheets, which were obtained as follows. The type A steel given in Table 1 (the steel of the invention) was used to be subjected to the hot rolling, the pickling, and the cold rolling in the described manner. Thereafter, the steel sheets each were annealed for 50 seconds by changing the soaking temperature in a range from about 780 to 880° C., (and then the primary cooling rate was set to a range from 4.9 to 7.5° C./s, while the secondary cooling rate was set to a range from 4.0 to 7.6° C./s). FIG. 2 shows that if the soaking temperature is controlled to be not less than 820° C., there are no increases in the tensile strength (TS) and the yield strength (YP).

FIG. 3 is a graph showing the results of measuring the above properties of the hot-dip galvanized steel sheets, when they were produced as follows. The type A steel given in Table 1 (the steel of the invention) was used to be subjected to the hot rolling, the pickling, and the cold rolling in the described manner. Thereafter, the thus-obtained steel sheets each were annealed for 15 to 80 seconds at the annealing temperature of about 832 to 864° C., and then the primary cooling rate was changed in a range from 2.7 to 19.3° C./s (while the secondary cooling rate was set to a range from 1.1 to 38.6° C./s). FIG. 3 shows that when the annealing process is performed at an appropriate temperature using the type A steel whose composition satisfies the ranges of the invention, there are no variations in the above properties even if the primary cooling rate is variously changed as shown in FIG. 3, so that the hot-dip galvanized steel sheet with excellent material properties is obtained.

FIG. 4 is a graph showing the results of measuring the above properties of the hot-dip galvanized steel sheets, when they were produced as follows. The type A steel given in Table 1 (the steel of the invention) was used to be subjected to the hot rolling, the pickling, and the cold rolling in the described manner. Thereafter, the steel sheets each were annealed for 15 to 80 seconds at the soaking temperature of about 832 to 864° C., and then the primary cooling rate was set to a range from 2.7 to 569° C./s, while the secondary cooling rate was changed in a range from 1.1 to 38.6° C./s. FIG. 4 shows that when the annealing process is performed at an appropriate temperature using the type A steel whose composition satisfies the ranges of the invention, there are no variations in the above properties even if the secondary cooling rate is variously changed as shown in FIG. 4.

TABLE 1

| Type of steel | Chemical compositions (% by mass; balance Fe and unavoidable impurities) | | | | | | | |
|---|---|---|---|---|---|---|---|---|
| | C | Si | Mn | P | S | Al | Cr | Mo |
| A | 0.08 | 0.01 | 2.95 | 0.015 | 0.002 | 0.052 | 0.32 | 0.28 |
| B | 0.09 | 0.02 | 2.84 | 0.013 | 0.002 | 0.036 | 0.29 | 0.29 |
| C | 0.14 | 0.01 | 2.28 | 0.010 | 0.005 | 0.041 | 0.25 | 0.28 |
| D | 0.06 | 0.02 | 2.76 | 0.012 | 0.003 | 0.045 | 0.22 | 0.29 |
| E | 0.08 | 0.02 | 2.49 | 0.010 | 0.003 | 0.040 | 0.20 | 0.29 |
| F | 0.14 | 0.01 | 2.61 | 0.012 | 0.003 | 0.044 | 0.21 | 0.29 |
| G | 0.05 | 0.03 | 3.47 | 0.009 | 0.004 | 0.032 | 0.21 | 0.39 |
| H | 0.08 | 0.02 | 3.17 | 0.011 | 0.010 | 0.060 | 0.44 | 0.21 |
| I | 0.13 | 0.02 | 3.03 | 0.012 | 0.008 | 0.050 | 0.27 | 0.31 |
| J | 0.07 | 0.04 | 2.93 | 0.017 | 0.003 | 0.029 | 0.23 | 0.48 |
| K | 0.11 | 0.01 | 2.80 | 0.014 | 0.007 | 0.043 | 0.30 | 0.32 |
| L | 0.08 | 0.01 | 2.92 | 0.007 | 0.012 | 0.033 | 0.44 | — |
| M | 0.08 | 0.03 | 3.42 | 0.009 | 0.004 | 0.032 | 0.28 | 0.42 |
| N | 0.08 | 0.02 | 2.90 | 0.005 | 0.015 | 0.048 | 0.12 | 0.35 |
| O | 0.06 | 0.02 | 3.63 | 0.004 | 0.002 | 0.036 | 0.21 | 0.26 |

TABLE 2

| | | | | Hot dip galvanizing process | | | | |
|---|---|---|---|---|---|---|---|---|
| | | Soaking temperature | | Primary cooling | | Secondary cooling | | |
| No. | Type of steel | Temperature (° C.) | Time (sec) | Rate (° C./sec) | End point temperature (° C.) | Rate (° C./sec) | End point temperature (° C.) | Galvanizing Temperature (° C.) |
| 1 | A | 866 | 50 | 7.2 | 595 | 5.9 | 511 | 465 |
| 2 | A | 863 | 80 | 6.0 | 504 | 1.1 | 479 | 455 |

TABLE 2-continued

| | | | | Hot dip galvanizing process | | | | |
|---|---|---|---|---|---|---|---|---|
| | | Soaking | | Primary cooling | | Secondary cooling | | |
| | Type | temperature | | | End point | | End point | Galvanizing |
| No. | of steel | Temperature (° C.) | Time (sec) | Rate (° C./sec) | temperature (° C.) | Rate (° C./sec) | temperature (° C.) | Temperature (° C.) |
| 3 | B | 850 | 50 | 6.1 | 620 | 6.3 | 530 | 462 |
| 4 | B | 856 | 140 | 2.5 | 603 | 2.4 | 513 | 474 |
| 5 | C | 860 | 40 | 7.5 | 622 | 6.5 | 543 | 452 |
| 6 | C | 850 | 70 | 4.1 | 627 | 4.5 | 533 | 484 |
| 7 | D | 840 | 50 | 7.6 | 555 | 3.4 | 507 | 455 |
| 8 | D | 863 | 50 | 7.4 | 587 | 4.7 | 520 | 465 |
| 9 | E | 842 | 50 | 6.0 | 618 | 6.9 | 520 | 470 |
| 10 | E | 839 | 70 | 4.9 | 595 | 3.1 | 536 | 474 |
| 11 | E | 862 | 80 | 4.5 | 593 | 2.7 | 531 | 470 |
| 12 | F | 841 | 50 | 7.5 | 580 | 9.9 | 449 | 440 |
| 13 | F | 837 | 50 | 6.0 | 626 | 12.3 | 463 | 458 |
| 14 | G | 846 | 20 | 15.7 | 611 | 15.8 | 521 | 463 |
| 15 | G | 853 | 80 | 4.5 | 586 | 3.3 | 510 | 458 |
| 16 | H | 862 | 30 | 9.3 | 630 | 11.2 | 524 | 463 |
| 17 | H | 849 | 80 | 4.4 | 587 | 3.7 | 503 | 457 |
| 18 | I | 842 | 50 | 5.1 | 651 | 8.6 | 529 | 461 |
| 19 | I | 856 | 100 | 3.7 | 580 | 2.7 | 502 | 440 |
| 20 | J | 849 | 20 | 18.7 | 594 | 20.1 | 490 | 443 |
| 21 | J | 860 | 50 | 7.2 | 589 | 5.8 | 521 | 462 |
| 22 | K | 864 | 30 | 10.7 | 618 | 12.0 | 513 | 469 |
| 23 | K | 870 | 50 | 7.0 | 608 | 7.5 | 501 | 448 |
| 24 | L | 852 | 40 | 8.5 | 598 | 8.0 | 507 | 459 |
| 25 | L | 852 | 70 | 5.4 | 582 | 3.7 | 512 | 455 |
| 26 | M | 863 | 80 | 6.0 | 504 | 1.1 | 479 | 455 |
| 27 | M | 855 | 50 | 6.5 | 610 | 4.7 | 543 | 490 |
| 28 | N | 870 | 40 | 10.7 | 550 | 4.2 | 502 | 461 |
| 29 | N | 845 | 60 | 5.5 | 610 | 5.1 | 527 | 479 |
| 30 | O | 840 | 50 | 7.6 | 555 | 3.4 | 507 | 455 |
| 31 | O | 863 | 50 | 7.4 | 587 | 4.7 | 520 | 465 |

TABLE 3

| | Type | Mechanical properties | | | | | | | | Weldability Nugget diameter = 7.0 mm |
|---|---|---|---|---|---|---|---|---|---|---|
| | of | YP | | TS | | EL | | TSS | CTS | |
| No. | steel | (MPa) | Difference* | (MPa) | Difference* | (%) | Difference* | (KN) | (KN) | CTS/TSS |
| 1 | A | 687 | 12 | 1014 | 11 | 13.2 | 0.1 | 29.4 | 14.8 | 0.50 |
| 2 | A | 675 | | 1003 | | 13.1 | | 29.0 | 14.5 | 0.50 |
| 3 | B | 686 | 4 | 1021 | 5 | 12.0 | 1.8 | 28.5 | 14.3 | 0.50 |
| 4 | B | 682 | | 1016 | | 13.8 | | 28.9 | 14.5 | 0.50 |
| 5 | C | 698 | 25 | 1034 | 67 | 14.0 | 2.5 | 35.0 | 13.1 | 0.37 |
| 6 | C | 723 | | 967 | | 16.5 | | 33.2 | 12.4 | 0.37 |
| 7 | D | 583 | 18 | 844 | 9 | 15.5 | 0.2 | 32.2 | 16.5 | 0.51 |
| 8 | D | 601 | | 853 | | 15.3 | | 31.8 | 16.3 | 0.51 |
| 9 | E | 613 | 15–32 | 912 | 21–85 | 15.4 | 0.1–0.8 | 33.2 | 15.7 | 0.47 |
| 10 | E | 581 | | 848 | | 15.5 | | 33.7 | 15.1 | 0.45 |
| 11 | E | 596 | | 827 | | 16.2 | | 32.8 | 16.0 | 0.49 |
| 12 | F | 725 | 26 | 1114 | 44 | 12.5 | 0.7 | 37.1 | 12.3 | 0.33 |
| 13 | F | 751 | | 1158 | | 11.8 | | 37.6 | 13.1 | 0.35 |
| 14 | G | 703 | 8 | 1005 | 13 | 12.8 | 0.5 | 30.0 | 13.9 | 0.46 |
| 15 | G | 695 | | 1018 | | 12.3 | | 30.5 | 13.3 | 0.44 |
| 16 | H | 670 | 5 | 1034 | 6 | 13.0 | 0.4 | 29.5 | 14.5 | 0.49 |
| 17 | H | 665 | | 1028 | | 13.4 | | 28.7 | 13.9 | 0.48 |
| 18 | I | 872 | 9 | 1242 | 9 | 8.5 | 0.2 | 33.8 | 12.9 | 0.38 |
| 19 | I | 881 | | 1251 | | 8.3 | | 34.0 | 13.1 | 0.39 |
| 20 | J | 668 | 9 | 996 | 7 | 13.5 | 0.2 | 29.1 | 15.2 | 0.52 |
| 21 | J | 677 | | 1003 | | 13.3 | | 29.4 | 14.9 | 0.50 |
| 22 | K | 730 | 5 | 1072 | 9 | 12.0 | 0.4 | 30.8 | 13.9 | 0.45 |
| 23 | K | 725 | | 1081 | | 11.6 | | 30.2 | 14.4 | 0.48 |
| 24 | L | 628 | 26 | 968 | 34 | 14.0 | 1.3 | 30.0 | 14.3 | 0.48 |
| 25 | L | 602 | | 934 | | 15.3 | | 30.6 | 14.7 | 0.48 |
| 26 | M | 795 | 1 | 1183 | 7 | 10.4 | 0.2 | 30.1 | 13.3 | 0.44 |
| 27 | M | 796 | | 1190 | | 10.2 | | 30.5 | 13.1 | 0.43 |

TABLE 3-continued

| | Type | Mechanical properties | | | | | | Weldability Nugget diameter = 7.0 mm | | |
|---|---|---|---|---|---|---|---|---|---|---|
| | of | YP | | TS | | EL | | TSS | CTS | |
| No. | steel | (MPa) | Difference* | (MPa) | Difference* | (%) | Difference* | (KN) | (KN) | CTS/TSS |
| 28 | N | 641 | 16 | 952 | 24 | 13.9 | 0.8 | 29.4 | 12.9 | 0.44 |
| 29 | N | 625 | | 928 | | 14.7 | | 27.9 | 12.0 | 0.43 |
| 30 | O | 801 | 8 | 1154 | 11 | 8.8 | 0.3 | 33.1 | 13.4 | 0.40 |
| 31 | O | 793 | | 1143 | | 9.1 | | 32.8 | 13.2 | 0.40 |

Note:
The "Difference*" means variations in (or differences between the maximums and the minimums of) each of properties (YP, TS, EL) of galvanized steel plates, which have been fabricated using various types of steels (A to O) by changing conditions.

What is claimed is:

1. A hot-dip galvanized steel sheet, wherein 95 area % or more of a steel of the hot-dip galvanized steel sheet is ferrite and martensite, wherein the steel of the hot-dip galvanized steel sheet comprises, by mass % (the contents of the following elements being expressed in the same manner), C: 0.05 to 0.12%, Si: not more than 0.05%, Mn: 2.7 to 3.5%, Cr: 0.2 to 0.5%, Mo: 0.2 to 0.5%, Al: not more than 0.10%, P: not more than 0.03%, and S: not more than 0.03%, and wherein the hot-dip galvanized steel sheet has a tensile strength in a range from 780 to 1180 MPa and a ductility ratio of 0.40 or more, the ductility ratio being a ratio of cross tensile strength to shear tensile strength.

2. The hot-dip galvanized steel sheet according to claim 1, wherein the steel comprises 0.05 to 0.10% of C.

3. The hot-dip galvanized steel sheet according to claim 1, wherein the steel comprises not more than 0.03% of Si.

4. The hot-dip galvanized steel sheet according to claim 1, wherein the steel comprises 2.9 to 3.5% of Mn.

5. The hot-dip galvanized steel sheet according to claim 1, wherein 98 area % or more of the steel comprises ferrite and martensite.

6. The hot-dip galvanized steel sheet according to claim 1, wherein the steel is obtained by a soaking process in which the temperature is set to a range from 820 to 900° C., and the time is not less than 15 seconds.

7. The hot-dip galvanized steel sheet according to claim 6, wherein the steel is obtained by a soaking process in which the temperature is set to a range from 820 to 900° C., and the time is not less than 30 seconds.

8. The hot-dip galvanized steel sheet according to claim 1, wherein the hot-dip galvanized steel sheet is further subjected to an alloying process.

9. A method of making a galvanized steel sheet, the method comprising hot-dip galvanizing a steel sheet; and producing the hot-dip galvanized steel sheet of claim 1.

* * * * *